US005148650A

United States Patent [19]

Yamada et al.

[11] Patent Number: 5,148,650

[45] Date of Patent: Sep. 22, 1992

[54] RADIATING TRUSS ROOF SUPPORT ARRAY AND CONSTRUCTION METHOD THEREFOR

[75] Inventors: Toshiyuki Yamada; Yoshihiro Takahama; Hajime Nakajima; Takayuki Nishiya, all of Tokyo, Japan

[73] Assignee: Shimizu Construction Co., Ltd., Tokyo, Japan

[21] Appl. No.: 752,062

[22] Filed: Aug. 29, 1991

Related U.S. Application Data

[62] Division of Ser. No. 354,452, May 19, 1989, Pat. No. 5,058,334.

[30] Foreign Application Priority Data

May 20, 1988 [JP] Japan ..... 63-123353

[51] Int. Cl.[5] ..... E04B 1/32

[52] U.S. Cl. ..... 52/747; 52/741

[58] Field of Search ..... 52/741, 747

[56] References Cited

U.S. PATENT DOCUMENTS

| | | | |
|---|---|---|---|
| 3,417,520 | 12/1968 | Fink | 52/80 |
| 4,137,687 | 2/1979 | Sprung | 52/6 |
| 4,275,534 | 1/1981 | Porter | 52/82 |
| 4,697,397 | 10/1987 | Okuda | 52/223 R |

FOREIGN PATENT DOCUMENTS

| | | | |
|---|---|---|---|
| 1451762 | 9/1966 | France | 52/82 |
| 2150066 | 6/1987 | United Kingdom . | |

OTHER PUBLICATIONS

Popular Mechanics "Domed College Arena Built without Pillars" p. 75 ©Aug. 1956.

Architectural Record "Prestressing Prevents Flutter of Caple Roof" pp. 178-181 ©Aug. 1959.

*Primary Examiner*—Henry E. Raduazo

*Attorney, Agent, or Firm*—Darby & Darby

[57] ABSTRACT

With the conventional radiating truss roof support array, the inner-truss connecting members form multiple complete rings radiating from the central portion of the roof to the periphery at fixed intervals. When tension is applied to the periphery of the roof, a constricting annular compression is generated in each of the concentric rings of inner-truss connecting members. By this mechanism, the tension applied to the periphery is somewhat dissipated, and a less than optimal effect on the curvature of the dome of the roof is achieved for a given amount of tension applied to the periphery. The present invention concerns a radiating truss roof support array constructed in such a manner as to eliminate the above described problem of induced annular constriction in the concentric rings of inner-truss connecting members. This goal is achieved by interrupting the concentric rings of inner-truss connecting members at fixed intervals so that predetermined adjacent trusses are not connected together by the above mentioned inner-truss connecting members. the concentric rings of inner-truss connecting members thus formed are incomplete at predetermined portions and the annular constriction is thus eliminated. Thereby, the tension applied to the periphery of the structure is used to maximum effect in maintaining the curvature of the dome of the roof.

7 Claims, 2 Drawing Sheets

RADIATING TRUSS ROOF SUPPORT ARRAY AND CONSTRUCTION METHOD THEREFOR

This is a division of application Ser. No. 354,452, filed May 19, 1989 now U.S. Pat. No. 5,058,334.

BACKGROUND OF THE INVENTION

In the construction of roofs that are both significantly long and wide, a radiating truss roof support array is a known means of forming and supporting such a roof. FIGS. 3 and 4 illustrate an earlier prototype of a radiating truss roof support array, as a development step by the same inventors in this application. FIG. 3 is being a cross sectional view in the vertical plane along the long axis of the structure and FIG. 4 being a plan view of the same. In the drawings, 1 represents the radiating truss roof support array. The roof is comprised of multiple steel framed trusses 2, 2, . . . , which when viewed from the side, are seen to form an arc. The roof is supported from below by multiple columns 3, 3, . . . , which when viewed from above, are seen to form an oval configuration. The multiple inter-truss connecting members 4, 4, . . . , connect adjacent pairs of trusses 2 from the side, and when viewed from above, can be seen to form multiple concentric rings radiating from the center of the roof to the periphery at fixed intervals. An oval shaped central ring girder 5 is provided in the central portion of the construction, the lower-most part of which forms a tension ring 5*a* which connects with the peripheral portions of the trusses 2 via multiple cables 6, 6, . . . , which lie in the same vertical plane with their respective trusses 2, 2, . . . The multiple cables 6, 6, . . . , supply in turn, a suitable amount of tension to the periphery of the structure, thereby governing the stress applied to the trusses 2, thus achieving the desired degree of curvature in the dome of the roof.

However, with such an arrangement as described above, where the inner-truss connecting 4 members form multiple complete rings radiating from the central portion of the roof to the periphery at fixed intervals, the tension applied by the cables 6 to the periphery of the roof leads to a constricting annular compression in each of the concentric rings of inner-truss connecting members 4. By this mechanism, the tension applied by the cables 6 is somewhat dissipated, and a less than optimal effect on the curvature of the dome of the roof is achieved for a given amount of tension applied by the cables 6.

SUMMARY OF THE INVENTION

The present invention concerns a radiating truss roof support array constructed in such a manner as to eliminate the above described problem of induced annular constriction in the concentric rings of inner-truss connecting members 4, and thence, the diminishment of the effect of the cables 6 on the curvature of the dome of the roof. This goal is achieved by interrupting the concentric rings of inner-truss connecting members 4 at fixed intervals so that predetermined adjacent trusses 2 are not connected together by the above mentioned inner-truss connecting members 4. The concentric rings of inner-truss connecting members 4 thus formed are incomplete at predetermined portions and the annular constriction is thus eliminated. Thereby, the tension applied to the periphery of the structure by the cables 6 is used to maximum effect in maintaining the curvature of the dome of the roof.

DETAILED DESCRIPTION OF THE PREFERRED EMBODIMENTS OF THE INVENTION

Figure 2:
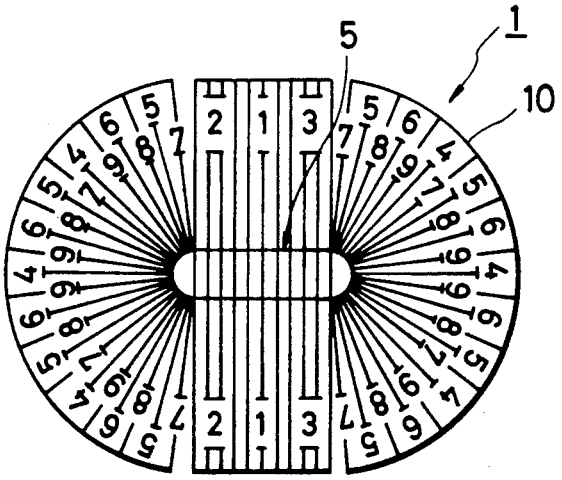
FIG. 2—An explanation of the order of application of forces into the radiating truss roof support array of the present invention is illustrated in FIG. 2.
Figure 3:
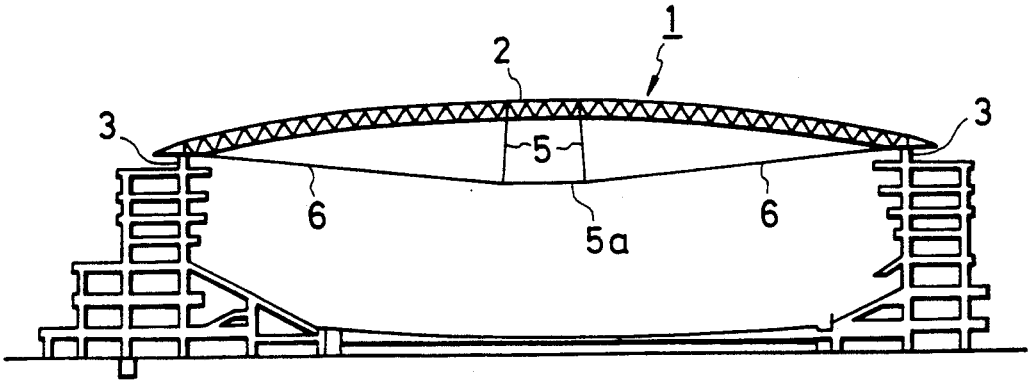
FIG. 3 represents a cross sectional view of an earlier prototype of a radiating truss roof support array taken in a vertical plane through the long axis of the building.
Figure 4:
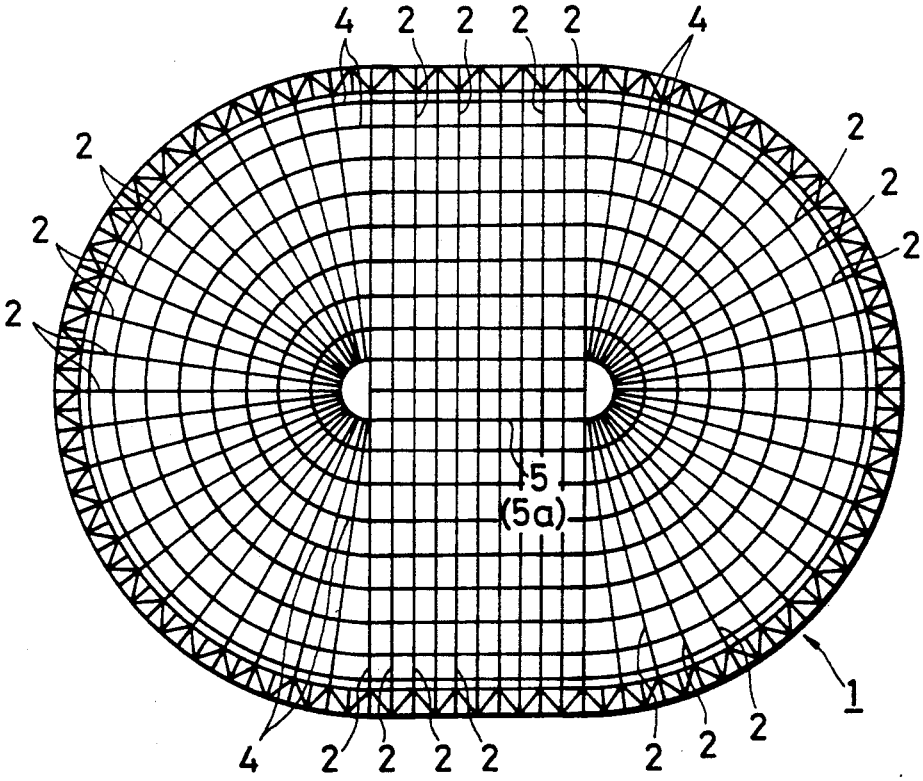
FIG. 4 is a plan view of the structure represented in FIG. 3.

In the following, the preferred embodiments of the present invention will be detailed with reference to FIG. 1 and FIG. 2. In general, elements in FIGS. 1 and 2 are numbered so as to correspond with the numbering of analogous elements in FIGS. 3 and 4, where FIGS. 1 and 2 represent the present invention and FIGS. 3 and 4 represent prototype in development of radiating truss roof support array.

Figure 1:
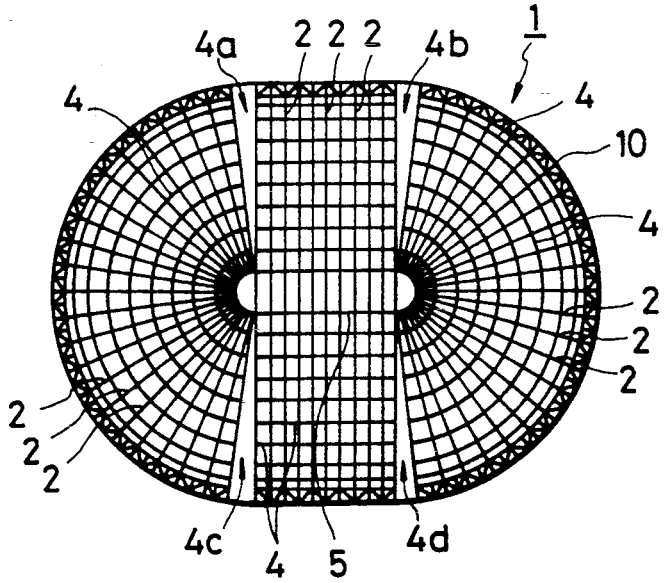
FIG. 1 represents a plan view of a radiating truss roof support array constructed in accordance with the present invention.

FIG. 1 represents a plan view of the present invention, the radiating truss roof support array itself shown by no. 1. An oval shaped central ring girder 5 is situated at the central portion of the structure and an oval shaped peripheral ring 10 is situated at the outer boundary. The multiple trusses 2, 2, . . . are suspended between the central ring girder 5 and the peripheral ring 10, extending outward from the central ring girder 5 in a radial pattern. Generally, between each adjacent pair of trusses 2, are multiple inner-truss connecting members 4, connecting the adjacent trusses, situated so as to form multiple concentric rings radiating from the central ring girder 5 to the peripheral ring 10 at fixed intervals. In accordance with the unique feature of the present invention, however, each concentric ring of inner-truss connecting members is discontinuous at four positions, thus forming four radial discontinuities in the overall structure 4*a*, 4*b*, 4*c*, 4*d*, generally corresponding with the four points along peripheral ring 10 where the straight line portions of the ring join with curved portions. In all other respects, the preferred embodiments of the present invention are analogous with those of the conventional radiating truss roof support array described above. Through the discontinuities thus provided, the concentric rings of inner-truss connecting members 4 are made to be incomplete, and thus, annular compression of the rings is impossible. Thereby, tension applied by the cables 6 on the trusses 2 is used to maximum effect in maintaining the arc of the dome of the roof.

In the present invention, the tension applied to the periphery of the structure by the multiple cables 6, 6, . . . is applied at fixed positions in ordered succession. This process of applying tension to the radiating truss roof support array will be described below with reference to FIG. 2.

Tension is first applied to the trusses connecting with the straight line portions of central ring girder 5, generally the most structurally stable part of the roof. These forces correspond to nos. 1, 2, and 3 in FIG. 2. Afterwards, tension is applied to the trusses which form a right angle at their connection with central ring girder 5, indicated by the nos. 4 in FIG. 2. Lastly, both of the end portions of the structure, where the central ring girder 5 and the peripheral ring 10 assume a curved contour, are equally divided in half, thus creating four arcs of equal size. In each of the four arcs, force is incrementally applied to the trusses 2 as indicated by nos. 5, 6, 7, and 8, in that order. In this way, tension may be gradually and incrementally applied to neighboring trusses so that corresponding trusses 2 on opposite halves of the structure are stressed in an equal and balanced fashion.

At this point, after tension has been applied to the structure as described above, in the four areas 4*a*, 4*b*, 4*c*, 4*d* where the inner-truss connecting members 4 have been omitted, these inner-truss connecting members 4 may be inserted as desired. Thus, a structure with complete concentric rings radiating from the central ring girder 5 to the peripheral ring 10 at fixed intervals may be constructed with no undesirable annular constriction of the concentric rings of inner-truss connecting members 2. Similarly, these concentric rings may be left open to the extent desired by inserting the additional inner-truss connecting members 2 at 4*a*, 4*b*, 4*c*, or 4*d* at predetermined locations.

What is claimed is:

1. A method for assembling a radiating truss roof support array, comprising the steps:

providing a peripheral ring defining an outer periphery for an array;

locating a central girder within the periphery of said peripheral ring;

suspending a plurality of trusses, said trusses extending generally radially from said central girder to said peripheral ring for connecting said central girder to said peripheral ring;

connecting adjacent radial trusses with a plurality of inner truss members extending generally perpendicularly from the associated radial trusses to form multiple concentric rings of said inner truss members, said rings radiating from said central girder outward to said peripheral ring, said concentric rings being separated by first fixed intervals, being interrupted at second fixed intervals leaving predetermined adjacent radial trusses unconnected by said inner-truss members.

2. A method for assembling a radiating truss roof support array as in claim 1, and further comprising the step:

tensioning said radial trusses between said central girder and peripheral ring.

3. A method of assembling a radiating truss roof support array as in claim 2, and further comprising the step:

completing said interrupted concentric rings after said tensioning by inserting additional inner-truss members to connect adjacent radial trusses at at least a portion of said second intervals.

4. A method of assembling a radiating truss roof support array as in claim 2, wherein said tensioning of said radial trusses is completed in a preselected sequence.

5. A method of assembling a radiating truss roof support array as in claim 1, and further comprising the step:

vertically supporting said peripheral ring.

6. A method as in claim 4, wherein said peripheral ring is an oval having a long axis, and a short axis and includes a pair of curved ends connected together by an intermediate straight portion, said sequence includes the steps of first tensioning the radial trusses of said straight portion and then tensioning the radial trusses of said curved portions.

7. A method as in claim 6, wherein in tensioning said radial trusses of said curved portions, the radial trusses parallel to said long axis and at 45° relative to said long axis are tensioned first.

* * * * *